US007798876B2

(12) United States Patent
Mix

(10) Patent No.: US 7,798,876 B2
(45) Date of Patent: Sep. 21, 2010

(54) KICKBOARD FOR SWIMMING

(75) Inventor: John Mix, Livermore, CA (US)

(73) Assignee: Finis Inc., Livermore, CA (US)

( * ) Notice: Subject to any disclaimer, the term of this patent is extended or adjusted under 35 U.S.C. 154(b) by 62 days.

(21) Appl. No.: 11/809,604

(22) Filed: Jun. 1, 2007

(65) Prior Publication Data

US 2008/0014810 A1 Jan. 17, 2008

Related U.S. Application Data

(60) Provisional application No. 60/810,386, filed on Jun. 1, 2006.

(51) Int. Cl.
*B63B 1/00* (2006.01)

(52) U.S. Cl. ..... 441/65

(58) Field of Classification Search ..... 441/55, 441/56, 58, 65

See application file for complete search history.

(56) References Cited

U.S. PATENT DOCUMENTS 4,437,842 A * 3/1984 Connor ..... 441/65
4,913,418 A * 4/1990 Schlueter et al. ..... 482/55
D329,633 S 9/1992 Rogers, Jr. et al. ..... D21/237
5,389,023 A * 2/1995 McIntyre ..... 441/65
5,868,592 A * 2/1999 Bulin et al. ..... 441/64
7,074,098 B1 * 7/2006 Acosta, Jr. ..... 441/65

* cited by examiner

*Primary Examiner*—Stephen Avila
(74) *Attorney, Agent, or Firm*—Jag Patent Services

(57) ABSTRACT

The present invention is directed to a kickboard. The kickboard includes a wedge-shaped flotation body with a top surface and a bottom surface. The kickboard preferably includes an adjustable strap feature for positioning a swimmer's hands in a flattened position while swimming with the kickboard in a forward position. The top surface preferably includes depression features for fitting or cradling against the swimmer's arms with the swimmer's arms outstretched. Preferably, the kickboard includes one or more fins protruding from the bottom surface of the wedge-shaped flotation body and the bottom surface includes one or more contoured channels to further stabilize the kickboard while swimming with the kickboard in the forward position.

8 Claims, 6 Drawing Sheets

KICKBOARD FOR SWIMMING

RELATED APPLICATION

This Application claims priority under 35 U.S.C. §119(e) from the U.S. Provisional Patent Application Ser. No. 60/810,386, filed on Jun. 1, 2006, and titled "AQUATIC ARTICLES", the contents of which are hereby incorporated by reference.

FIELD OF THE INVENTION

This invention relates to aquatic articles. More particularly, the present invention relates to aquatic articles for teaching proper swimming techniques.

BACKGROUND OF THE INVENTION

A number of aquatic articles are available for swimming and other water activities. For example, there are snorkels, face masks, fins and goggles, to name a few. There are also wet suits, swimming suits and other articles of clothing that are used by swimmers and divers alike. A number of aquatic articles have been developed to help swimmers develop or maintain proper swimming techniques.

One of the most important swimming techniques for swimming competitively is the swimmer's kicking technique. Swimmers often practice their kicking technique with a kickboard. In use, a swimmer rests an upper portion of his or her body or arms on a top surface of the kickboard and swims laps in a pool without using his or her arms.

SUMMARY OF THE INVENTION

Prior art kickboards fail to provide a mechanism for immobilizing or stabilizing a kickboard in front of and/or under a portion of a swimmer's body while the swimmer swims laps in a pool or other body of water with the kickboard in a forward position. Accordingly, the present invention is directed to an improved kickboard. The kickboard includes a mechanism for assisting the swimmer to hold and/or stabilize the kickboard in front and/or under a portion of his or her body while he or she swims laps in a pool with the kickboard in a forward position.

The kickboard of the present invention includes a flattened flotation body that is preferably a wedge-shaped flotation body. The wedge-shaped flotation body has a top surface and a bottom surface. The wedge-shaped flotation body is formed from any suitable material or materials including, but not limited to, foam, rubber, plastic and combinations thereof.

The kickboard preferably includes a securing feature coupled to the top surface of the flattened flotation body. The securing feature is configured for securing portions of a swimmer's hands, arms and/or head against the top surface of the wedge-shaped flotation body while swimming with the kickboard in a forward position.

In accordance with the embodiments of the invention the securing means includes a pocket feature coupled to the top surface of the wedge-shaped flotation body. In operation, the swimmer places his or her hands under the pocket feature and swims with the kickboard in the forward position. Preferably, the top surface of the wedge-shaped flotation body has depression features located along a bottom portion of the top surface of the wedge-shaped flotation body for resting a portion of the swimmer's body, such as the swimmer's arms and/or forehead.

In a preferred embodiment of the invention, the securing feature includes a strap member coupled to the top surface of the wedge-shaped flotation body. In operation, the swimmer places his or her hands under the strap member and swims with the kickboard in a forward position. In this embodiment, the top surface of the wedge-shaped flotation body also preferably includes depression features located along a bottom portion of the top surface of the wedge-shaped flotation body for resting a portion of the swimmer's body. The securing feature and the depression features described above allow the kickboard to be held and cradled against the swimmer's arms, thereby allowing the swimmer to stabilize or immobilize the kickboard in the forward position with the swimmer's arms outstretched, which is the most suitable posture for kick training.

Whether the securing feature is a pocket feature, a strap feature or a combination thereof, the securing feature preferably holds the swimmer's hands substantially flat against the top surface of the wedge-shaped flotation body.

In accordance with a preferred embodiment of the invention the kickboard includes a wedge-shaped flotation body with a securing feature for holding a swimmers' hands in a flat forward position against a top surface, such as described above, and further includes means for guiding the kickboard in a straight path as the kickboard moves through water. The means for guiding the kickboard in a straight path as the kickboard moves through water includes, for example, a plurality of fin structures protruding from the bottom surface of the wedge-shaped flotation body.

Alternatively to, or in addition to, the plurality of fin structures, the means for guiding the kickboard in a straight path as the kickboard moves through water includes a plurality of contour channels on the bottom surface of the wedge-shaped flotation body.

In a most preferred embodiment of the invention the securing feature is adjustable, such that a position and/or a location of the securing feature is adjustable relative to the top surface of the wedge-shaped flotation body. For example, where the securing feature is a strap feature, the strap feature is configured with a plurality of grooved or slotted features that mate or fit with matched stationary protruding features on the wedge-shaped flotation body. In operation, the strap feature is adjusted by pulling or pushing loop portions of the strap feature that extend through the bottom surface of the wedge-shaped flotation body to engage one or more of the slotted features on the strap feature with a corresponding one or more of the matched stationary protruding features on the wedge-shaped flotation body. It will be clear to one skilled in the art from the discussion above and below that whether the securing feature is a strap feature, pocket feature, any other suitable securing feature, or any combination of securing features, the securing feature can be configured to be adjustable relative to the top surface of the wedge-shaped flotation body using any suitable mechanism or mechanisms including, but not limited to, snap mechanisms, clip mechanisms, fitted geometric feature mechanisms and combinations thereof.

DETAILED DESCRIPTION OF THE INVENTION

FIGS. 1-A-B show views 100 and 150, respectively, of a swimmer 107 using kickboards 101 and 151, in accordance with the embodiments of the invention. The kickboards 101 and 151 include flattened flotation bodies that are preferably wedge-shaped flotation bodies 102 and 152. The wedge-shaped flotation bodies 102 and 152 are formed from any suitable material or materials including, but not limited to, foam, rubber, plastic and combinations thereof.

Figure 1A:
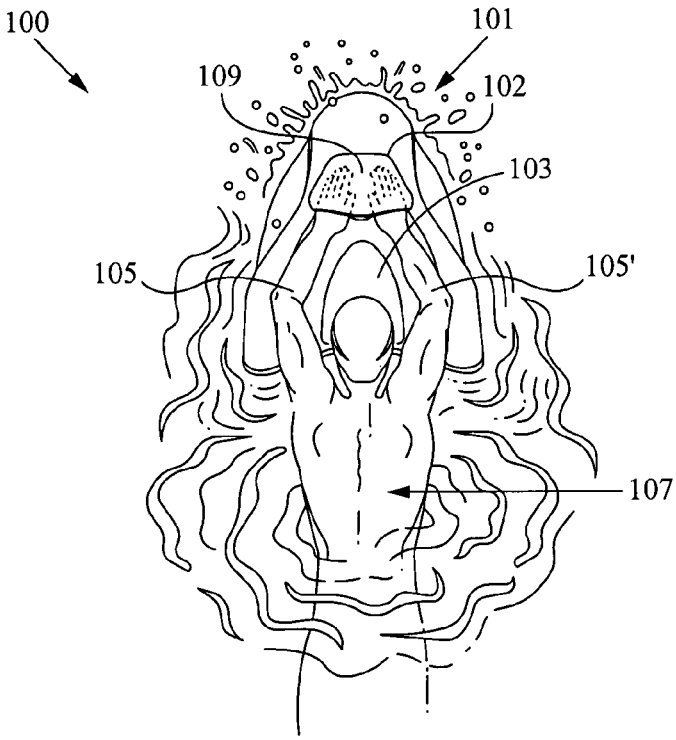
FIGS. 1A-B show views of a swimmer using kickboards, in accordance with the embodiments of the invention.

Referring to FIG. 1A the kickboard 101 has a securing feature that includes a pocket feature 109. The pocket feature 109 is preferably coupled to the top surface of the wedge-shaped flotation body 102. In operation, the swimmer 107 places his or her hands within the pocket feature 109 and swims with the kickboard 101 in the forward position, as shown. Preferably, the top surface of the wedge-shaped flotation body 102 has depression features 103 located along a bottom portion of the top surface of the wedge-shaped flotation body 102 for resting a portion of the swimmer's body, such as the swimmer's arms 105 and 105' or forehead.

Figure 1B:
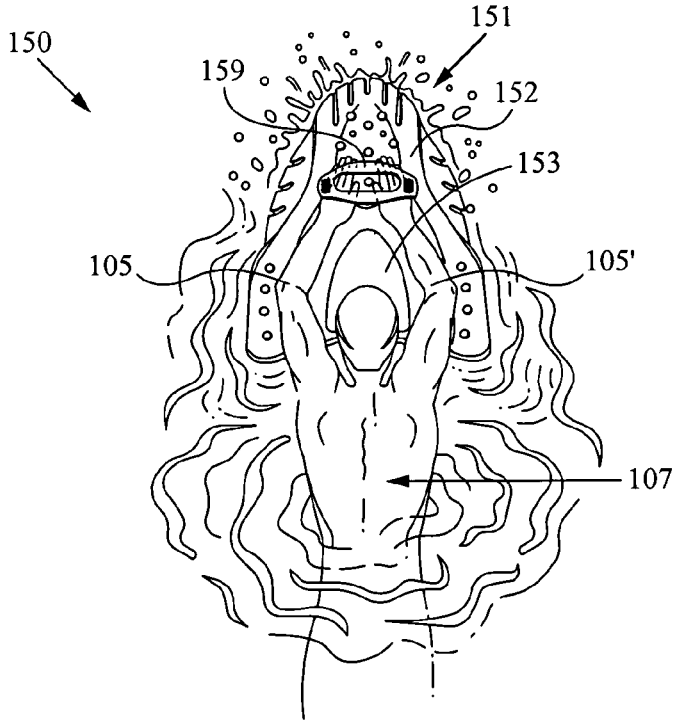
Figure 2A:
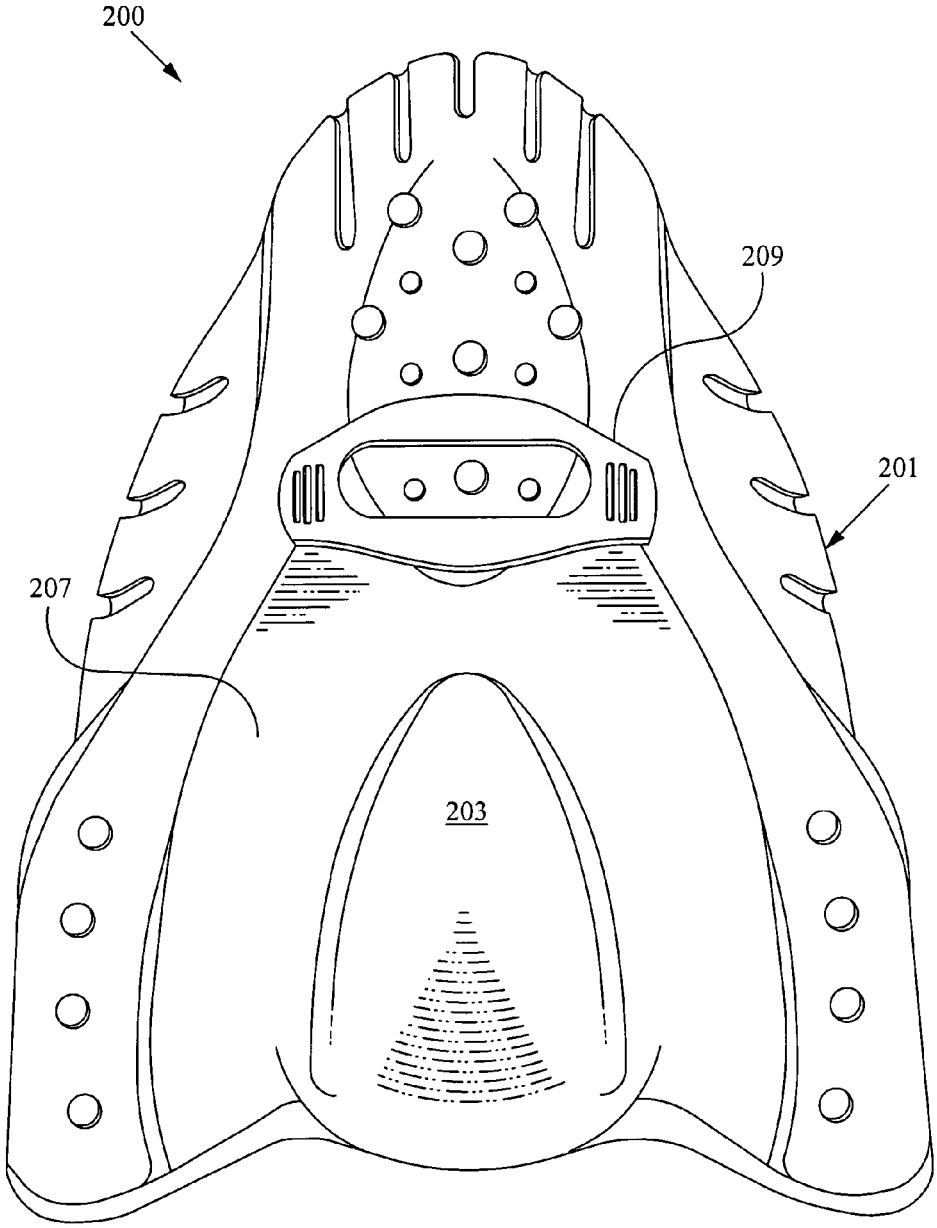
FIGS. 2A-E illustrate views of a kickboard, in accordance with a preferred embodiment of the invention.
Figure 2B:
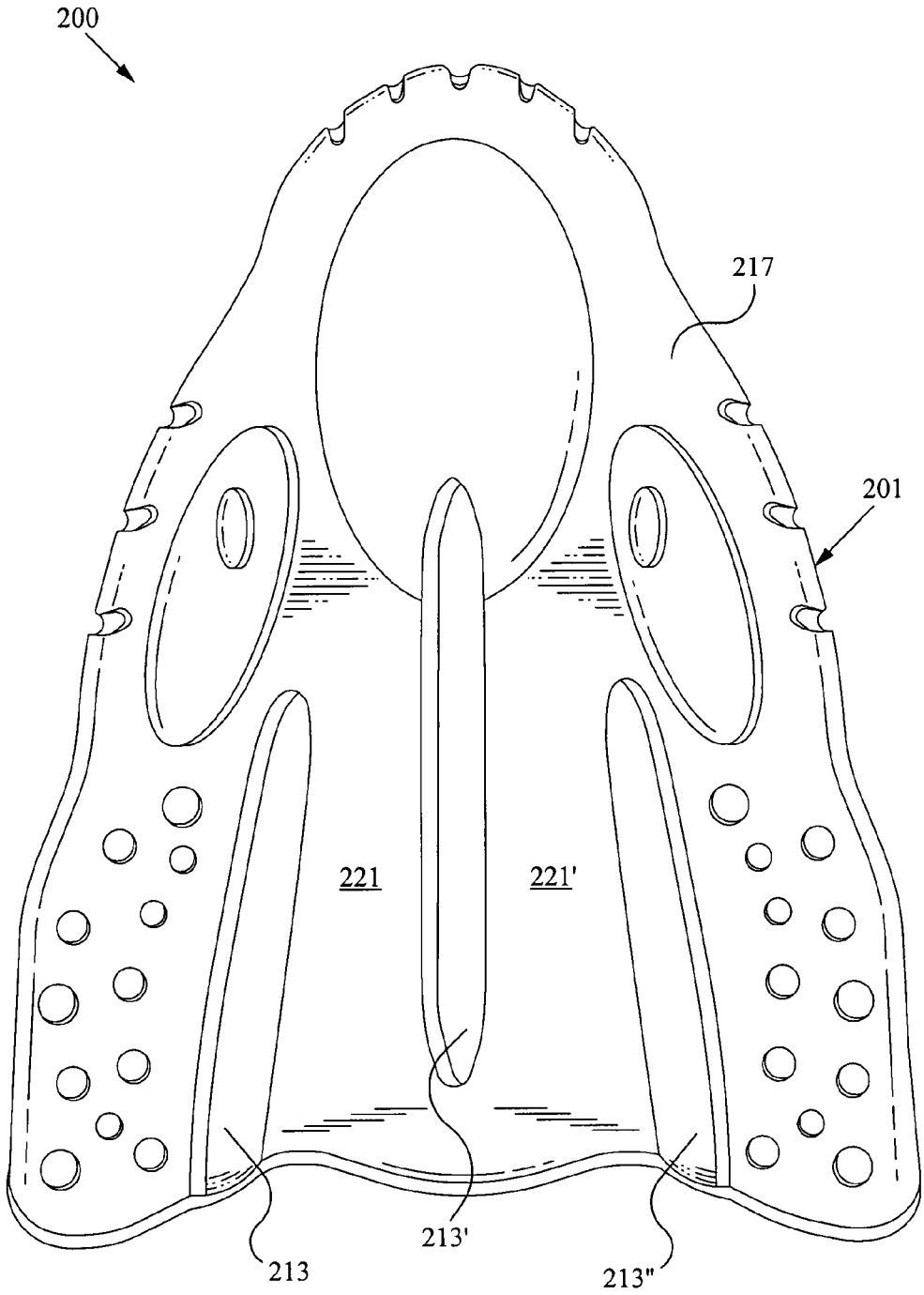
Figure 2C:
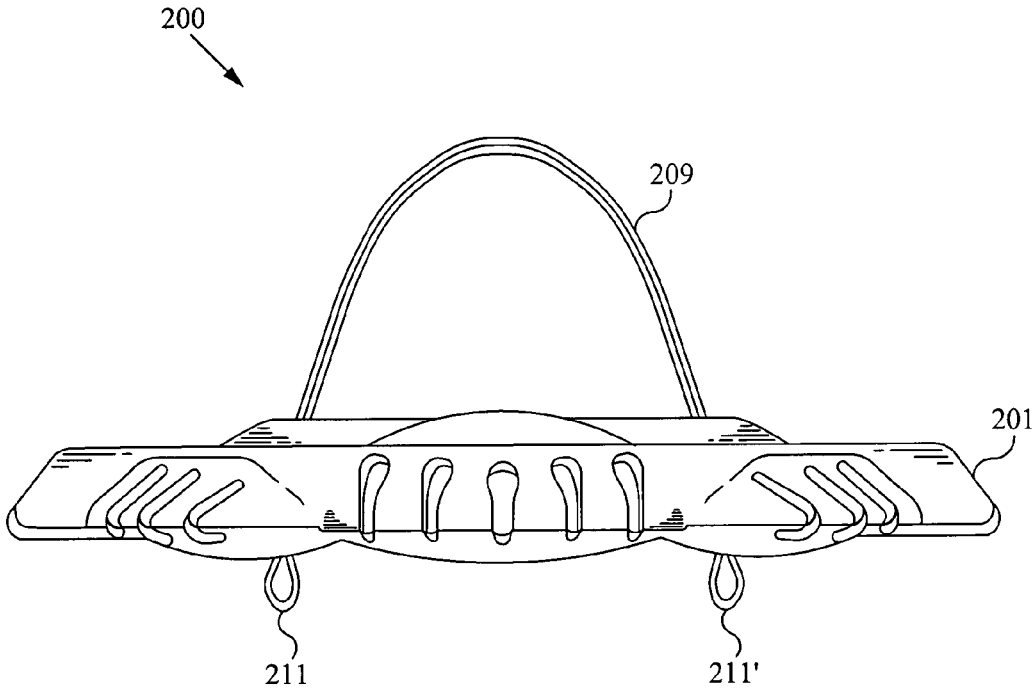
Figure 2D:
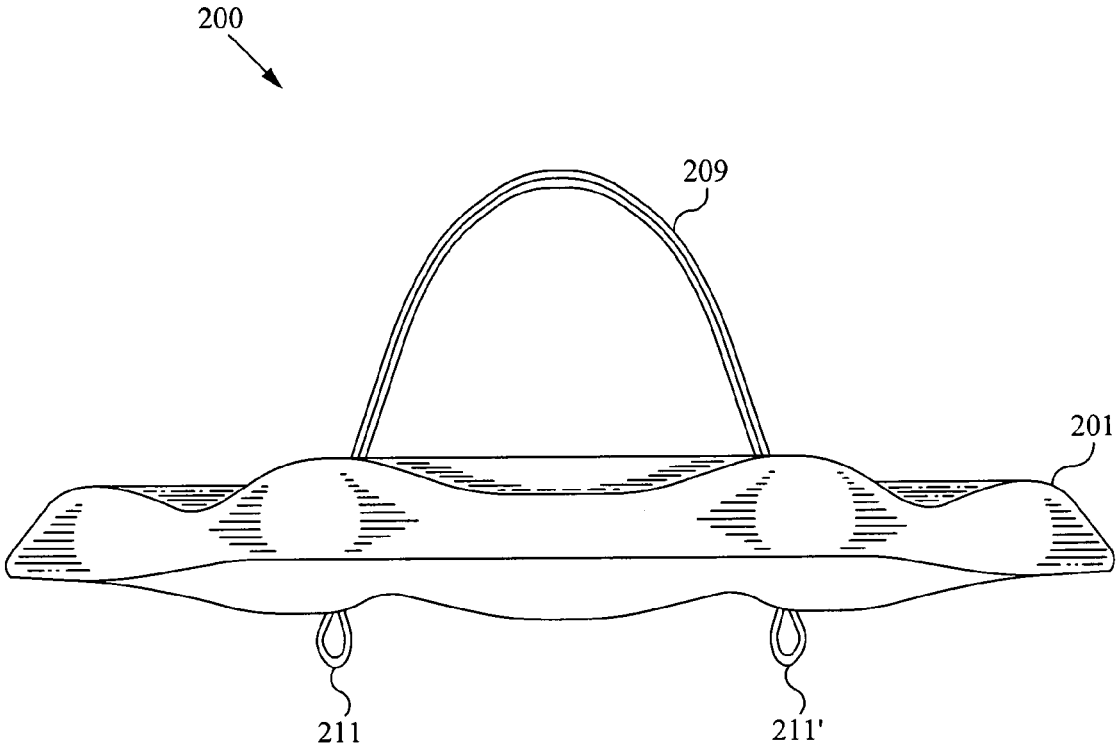
Figure 2E:
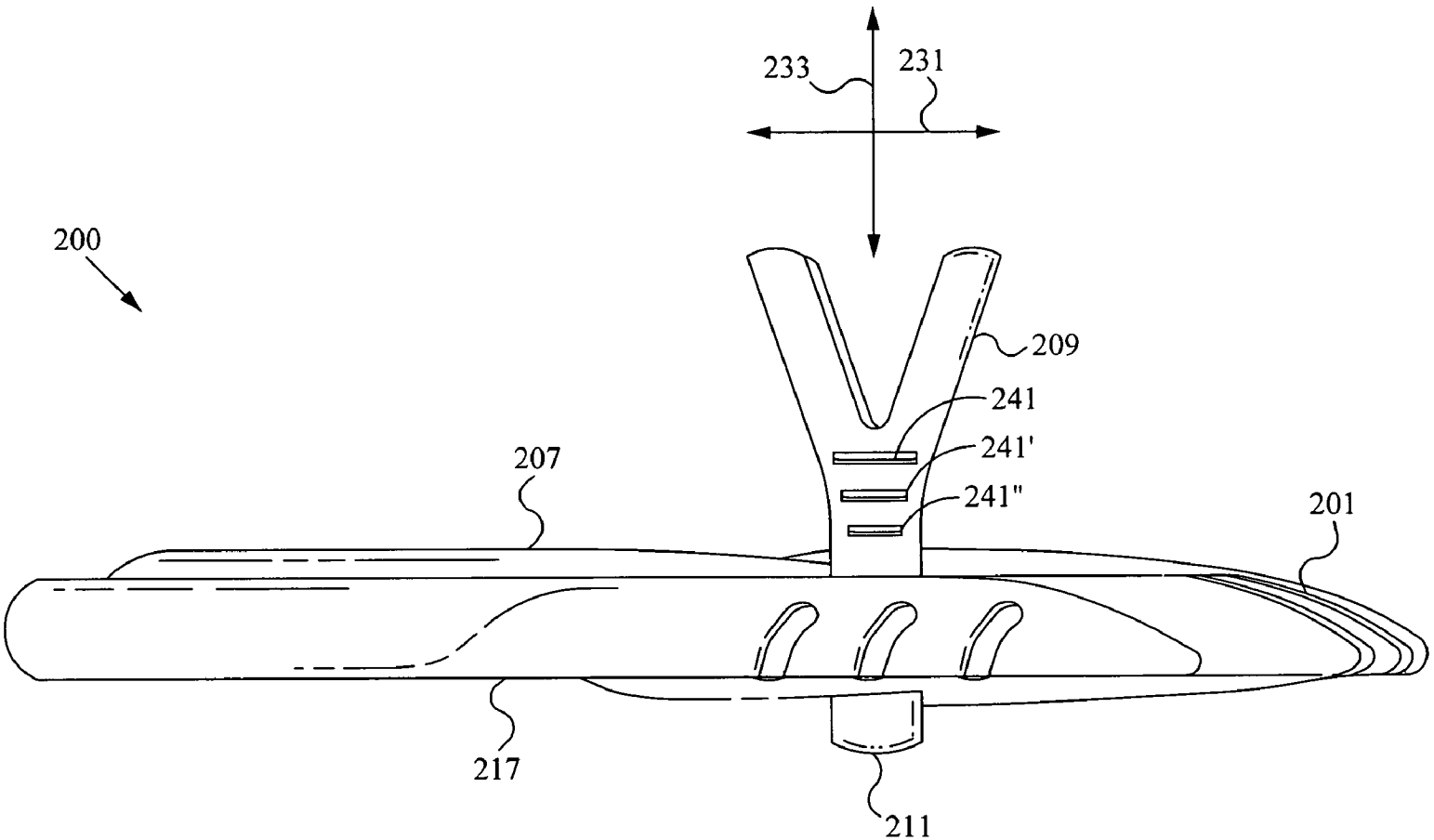

Referring now to FIG. 1B, in a preferred embodiment of the invention, the securing feature includes strap feature 159 coupled to the top surface of the wedge-shaped flotation body 152. In operation, the swimmer 107 places his or her hands under the strap feature 159 and swims with the kickboard 151 in a forward position, as shown. In this embodiment, the top surface of the wedge-shaped flotation body 152 also preferably includes depression features 153 located along a bottom portion of the top surface of the wedge-shaped flotation body 152 for resting a portion of the swimmer's body.

The securing features 109 and 159 and the depression features 103 and 153, described above, allow the kickboards 101 and 151 to be securely held and cradled against the swimmer's arms 105 and 105', thereby allowing the swimmer 107 to stabilize or immobilize the kickboards 101 and 151 in the forward position with the swimmer's arms 105 and 105' outstretched, as shown in FIGS. 1A-B.

FIGS. 2A-E illustrate views of a kickboard 200, in accordance with a preferred embodiment of the invention. In accordance with this preferred embodiment of the invention, the kickboard 200 includes a wedge-shaped flotation body 201 with a top surface 207 and a bottom surface 217. The kickboard 200 also includes a strap feature 209 coupled to the wedge-shaped flotation body 201. The strap feature 209 is coupled to the top surface 207, the bottom surface 217 or any other portion of the wedge-shaped flotation body 201. The strap feature 209 is configured for holding a swimmer's hands (not shown) flat against the top surface 207 of the wedge-shaped flotation body 201 while swimming with the kickboard 200 in a forward position, such described above with reference to FIGS. 1A-B. The strap feature 209 also allows a swimmer to maneuver the kickboard 200 while his or her body is in a outstretched submersed position, as shown in FIGS. 1A-B.

In accordance with further embodiments of the invention the kickboard 200 includes means for guiding the kickboard 200 in a straight path as the kickboard moves through water. The means for guiding the kickboard 200 in a straight path as the kickboard moves through water includes for example a plurality of fin structures 213, 213' and 213" protruding from the bottom surface 217 of the wedge-shaped flotation body 201. The wedge-shaped flotation body 201, in accordance with the embodiments of the invention is reticulated with holes of varying size that pass though the wedge-shaped flotation body 201. The holes allow the kickboard 200 to be readily taken under water or submersed in water by the swimmer.

Alternatively to, or in addition to, the plurality of fin structures 213, 213'and 213", the means for guiding the kickboard in a straight path as the kickboard moves through water includes a plurality contour channels 221 and 221' on the bottom surface 217 of the wedge-shaped flotation body 201.

In a most preferred embodiment of the invention, the strap feature 209 is adjustable, such that a position and/or a location of the strap feature 209 is adjustable relative to the top surface 207 of the wedge-shaped flotation body 201, as indicated by the arrows 231 and 233. For example, the strap feature 209 has a plurality of grooved or slotted features 241, 241' and 241" that mate or fit with matched stationary protruding features (not shown) on the wedge-shaped flotation body 201. In operation, the strap feature 209 is adjusted by pulling or pushing loop portions 211 and 211' of the strap feature 209 that extend through the bottom surface 217 of the wedge-shaped flotation body 201 to engage one or more of the grooved or slotted features 241, 241' and 241" on the strap feature 209 with a corresponding one or more of the matched stationary protruding features (not shown) on the wedge-shaped flotation body 201.

It will be clear to one skilled in the art from the discussion above and below that whether the securing feature is a strap feature, such as shown in FIGS. 1A and 2A-E, pocket feature, such as shown in FIG. 1B, or any other suitable securing feature, the securing feature can be configured to be adjustable relative to the top surface 207 of the wedge-shaped flotation body 201 using any suitable mechanism or mechanisms including, but not limited to, snap mechanisms, clip mechanisms, fitted geometric feature mechanisms and combinations thereof.

The present invention has been described in terms of specific embodiments incorporating details to facilitate the understanding of the principles of construction and operation of the invention. As such, references herein to specific embodiments and details thereof are not intended to limit the scope of the claims appended hereto. It will be apparent to those skilled in the art that modifications can be made in the embodiments chosen for illustration without departing from the spirit and scope of the invention.

What is claimed is:

1. A kickboard comprising:

a) a flattened flotation body that is wedge-shaped and has a top surface and a bottom surface with contour channels, wherein the top surface includes a depression for resting a portion of a swimmer's head with the swimmer's arms stretched forward and over the top surface, the flattened flotation body has a plurality of holes that pass through the flattened flotation body, such the kickboard is submersible while swimming with the kickboard; and b) means for securing portions of the swimmer's hands or arms to the kickboard while swimming with the portion of swimmer's head resting in the depression and swimmer's arms stretched forward and over the top surface, wherein the means for securing is coupled to the top surface of the flattened flotation body, wherein the means for securing includes a strap feature with a plurality of traverse slots and a pair of loops, one on each end of the strap, with each loop extending below the flattened flotation body and being used to pull the strap feature and engage the selected ones of the plurality of traverse slots and thereby adjust a length of the strap feature above top surface of the flattened flotation body.

2. The kickboard of claim 1, wherein the means for securing includes a pocket feature.

3. The kickboard of claim 1, wherein the flattened flotation body comprises of one or more materials selected from the group consisting of foam and plastic.

4. The kickboard of claim 1, further comprising a plurality of fin structures protruding from the bottom surface of the flattened flotation body.

5. A kickboard for training a swimmer, the kickboard comprising:

a) a wedge-shaped flotation body being reticulated with holes configured to pass water, wherein the holes pass through wedge-shaped flotation body, such that the kickboard is submersible by the swimmer;

b) a securing feature for inserting portions a swimmer's hands while swimming with the kickboard positioned in front the swimmer or underneath a portion of the swimmer, wherein the securing feature includes a strap feature with a plurality of traverse slots and a pair of loops, one on each end of the strap, with each loop extending below the wedge-shaped flotation body and being used to pull the strap feature and engage the selected ones of the plurality of traverse slots and thereby adjust a length of the strap feature above the wedge-shaped flotation body; and c) means for guiding the kickboard in a straight path as the kickboard moves through water, wherein the means for guiding the kickboard in a straight path includes contour channels on a bottom surface of the wedge-shaped flotation body and a plurality of fins attached to the bottom surface of the wedge-shaped flotation body.

6. The kickboard of claim 5, wherein the wedge-shaped flotation body is formed from a material selected from the group consisting of foam and plastic.

7. The kickboard of claim 5, wherein the wedge-shaped flotation body includes a depression along a bottom portion of a top surface of the wedge-shaped flotation body.

8. A kickboard comprising:

a) a wedge-shaped flotation body with a top surface and a bottom surface with contour channels, the top surface having a depression along a bottom portion of the top surface for resting a portion of a swimmer's head with the swimmer's hand stretched out forward over the top surface, wherein the wedge-shaped flotation body has a plurality of holes passing through the wedge-shaped flotation body for passing water such the kickboard is readily submersed in water;

b) an adjustable strap feature for positioning a swimmer's hands in a flattened position while swimming with the kickboard in front of the swimmer or underneath a portion of the swimmer, wherein the adjustable strap feature includes a plurality of traverse slots and a pair of loops, one on each end of the strap, with each loop extending below the wedge-shaped flotation body and being used to pull the strap feature and engage the selected ones of the plurality of traverse slots and thereby adjust a length of the strap feature above the top surface of the wedge-shaped flotation body; and c) a plurality of fins protruding from the bottom surface of the wedge-shaped flotation body.

* * * * *